US006275133B1

(12) United States Patent
Chen

(10) Patent No.: US 6,275,133 B1
(45) Date of Patent: Aug. 14, 2001

(54) SWITCH STRUCTURE

(75) Inventor: Chun-Hsu Chen, Pan-Chiao (TW)

(73) Assignee: Tsung-Mou Yu, Panchiao (TW)

( * ) Notice: Subject to any disclaimer, the term of this patent is extended or adjusted under 35 U.S.C. 154(b) by 0 days.

(21) Appl. No.: 09/454,928

(22) Filed: Dec. 3, 1999

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/379, 79, 59, 337/66, 761, 53, 67–69, 74, 75, 91, 39, 85, 112, 113, 140, 334, 345; 200/553–557

(56) References Cited

U.S. PATENT DOCUMENTS 3,358,099 * 12/1967 Bellomayre ..... 200/113
4,258,349 * 3/1981 Flory ..... 337/46
4,345,233 * 8/1982 Matthies ..... 337/75
4,528,538 * 7/1985 Andersen ..... 337/43
4,931,762 * 6/1990 Fierro ..... 337/66
5,012,495 * 4/1991 Munroe et al. .
5,262,748 * 11/1993 Tsung-Mou ..... 337/66
5,451,729 * 9/1995 Onderka et al. ..... 200/18
5,541,569 * 7/1996 Jang ..... 337/68
5,760,672 * 6/1998 Wang ..... 337/79
5,828,284 * 10/1998 Huang ..... 337/37
5,847,638 * 12/1998 Sorenson ..... 337/380
5,889,457 * 3/1999 Hsu et al. ..... 337/59
5,892,426 * 4/1999 Huang ..... 337/59
5,898,355 * 4/1999 Yu ..... 337/8
6,072,381 * 6/2000 Yu ..... 337/37
6,094,126 * 7/2000 Sorenson ..... 337/37
6,121,868 * 9/2000 Chiang ..... 337/37
6,154,116 * 11/2000 Sorenson ..... 337/37

FOREIGN PATENT DOCUMENTS

647094-A5 * 12/1984 (CH) ..... 337/333
19534611-A1 * 3/1996 (DE) ..... H01H/23/20
0694947-A1 * 1/1996 (EP) ..... H01H/71/54

* cited by examiner

*Primary Examiner*—Gerald Tolin
*Assistant Examiner*—Anatoly Vortman

(57) ABSTRACT

A switch structure comprises a control element, which comprises an alloy piece and a swinging device. The swinging device has an actuating element used to actuate the swinging device when the actuating element is pushed. When the alloy piece is overheated due to overloading of current, it will deform toward the actuating element so as to eject the actuating element, which causes the swing device to swing outwards and is released from the supporting of the stopper in the switch body. Then, the swing device moves towards the original closing position, and the elastic contacting piece is released from the pressing of the swing device to eject upwards. Two joints connected in an electric loop are tripped. The object of rapid response, cutting power source, and safety is therefore achieved.

13 Claims, 4 Drawing Sheets

SWITCH STRUCTURE

FIELD OF THE INVENTION

The present invention relates to a switch structure, and more specifically, to a power switch with a simpler structure that is capable of switching off the power source when the current is overloaded.

BACKGROUND OF THE INVENTION

Power switches with only two states of ON and OFF functions controlled manually have been widely used in many appliances. However, it is risky to use the above power switches when the power source is unstable because overheating may occur due to overloading of the appliance and the wires easily catche the fire. The users can not be aware of such latent danger since overloading and overheating are invisible. Therefore, such improved power switches have been greatly needed to overcome the danger.

Some improved power switch of the prior arts includes an alloy element composed of more than one metal to automatically shut off the power source when the alloy element is thermally deformed because of overheating.

For example, the power switch disclosed in the prior arts includes an alloy piece, a lever, and a cam actuator. The lever is actuated by the alloy piece, and the cam actuator is used to coordinate with a seesaw actuator. Thermal deformation of the alloy piece causes the lever to move, and then the cam actuator loses support, escapes and further cuts off the power source. Overheating may occur on he alloy piece. The above power switch uses the lever, the cam actuator, and the seesaw actuator to indirectly control the conductive plate, which is used to contact with the power source. The response of the power off operation in the above power switch when overheating occurs is so slow that the overloaded current may flow into the operating appliance in a short time to damage the appliance. Additionally, the conductive plate and the alloy piece need the wire to connect to each other, and the whole structure is complicated to cause the manufacturing to be difficult. The alloy piece has to actuate the seesaw actuator and the lever to escape. The function of automatic power off may incorrectly operate.

Furthermore, another conventional power switch uses the thermal deformation of the alloy piece to push a limited position base such that a button can automatically escape and return back. The button is used to directly contact with the contact point of the power source so that the button may conduct the overloaded current when overheating occurs. The whole structure is still complicated. In summary, those improved power switches in the prior arts can partly overcome the danger of overheating for the appliance but the response is slow and the whole structure is complicated. An advanced power switch with simpler structure and a short response time is greatly desired.

SUMMARY OF THE INVENTION

An object of the present invention is to provide a switch structure comprising a control element, which consists of an alloy piece and a swinging device. The swinging device has an actuating element used to actuate the swinging device when the actuating element is pushed. When the alloy piece is overheated due to overloading by the current, it will deforms toward the actuating element so as to eject the actuating element, which causes the swing device to swing outwards and to be released from the support of the stopper in the switch body. Then, the swing device moves towards the original closing position, and the elastic contacting piece is released from the pressing of the swing device to eject upwards. Two joints connected in an electric loop are tripped. The object of rapid response, cutting power source, and safety is therefore achieved.

Other features and advantages of the invention will become apparent from the following description of the invention which refers to the accompanying drawings.

DETAILED DESCRIPTION OF THE PREFERRED EMBODIMENTS

Figure 1:
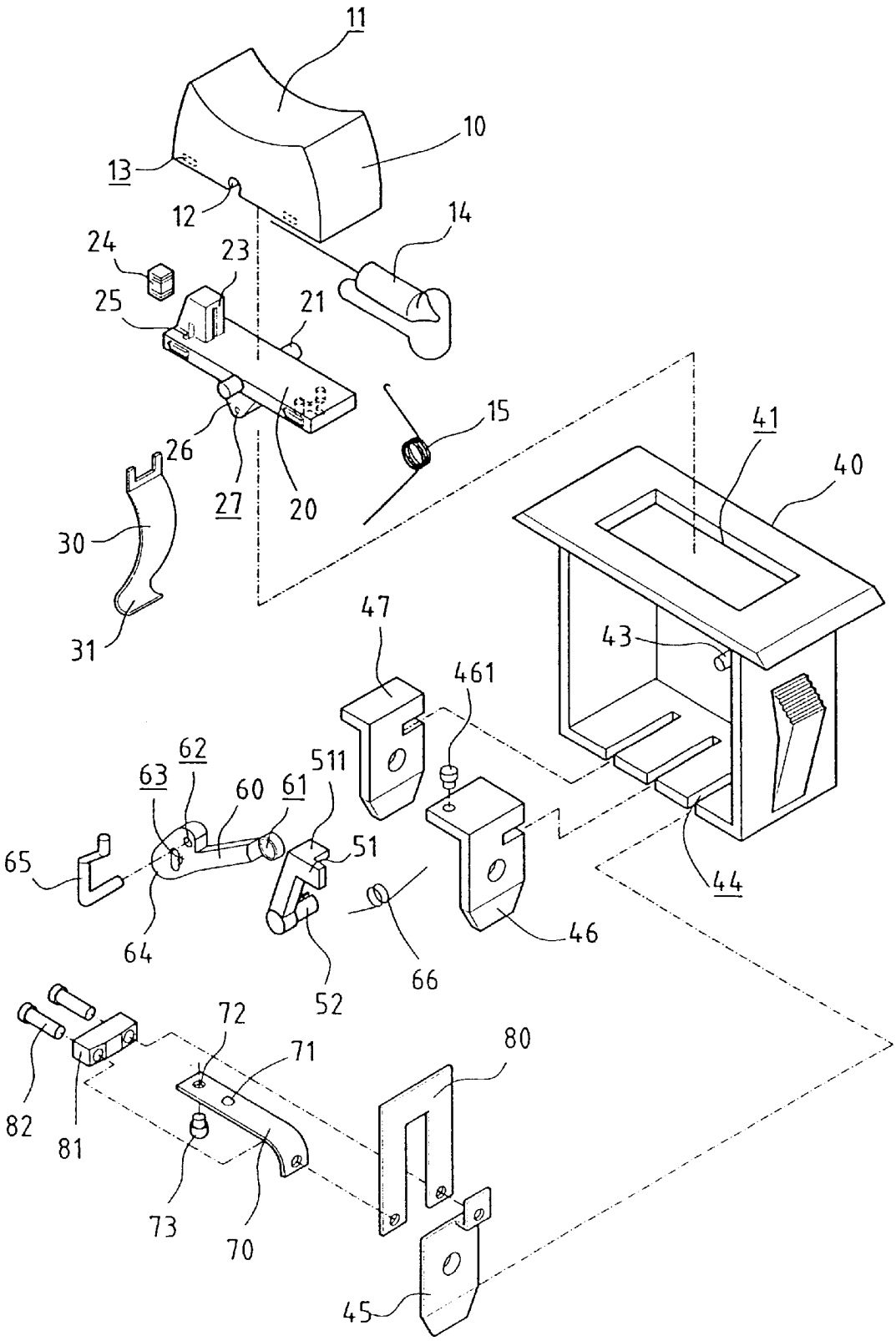
FIG. 1 shows the exploded diagram of the switch structure according to the present invention.

With reference to FIG. 1, the switch structure comprises a switch cover body 10, a contact reed 30, a switch body 40, a swing device 60, an elastic contact piece 70, and an alloy piece 80.

The switch cover body 10 includes a switch seat 20. The upper surface of the switch cover body 10 forms a concave cambered surface 11. Axial holes 12 and buckle holes 13 are formed at the proper positions at the two sides thereof. In the switch seat 20, two fulcrums 21 and two tenons 22 are installed at positions with respect to the axial holes 12 and buckle holes 13 of the switch cover body 10 to join the switch cover body 10, which presses in two directions along the fulcrums 21. A resistor seat 23 is formed at one side of the switch seat 20. A chip resistor 24 is embedded into the resistor seat 23 as a current limiting resistor of the neon lamp 14 within the switch cover body 10 for indicating that the switch is ON. Each side of the resistor seat 23 is installed with a through hole 25. The bottom of the switch seat 20 is installed with a triangular piece 26, which has a supporting rod hole 27.

One end of the contact reed 30 passes through the through hole 25 to contact with the chip resistor 24. Another end is bent to form s hook 31 so as to firmly combine with the third contact terminal 47 for supporting a dynamic force to recover the switch cover body 10 and for electrically connecting to one pin of the neon lamp 14.

The switch body 40 is a hollow shell with an opening 41. A stopper 42 and a fixing pillar 43 are installed at proper positions of the inner wall of the shell. The opening 41 at the top thereof is connected to the switch cover body 10. The bottom of the switch body 40 is installed with a plurality of inserting grooves 44, which are connected to a first, a second, and a third contact terminals 45, 46, and 47, respectively.

The swing device 60 has an elliptical slot 63 at one end to connect to the fixing pillar 43 of the switch body 40 in order to swing. The bottom forms a convex part 64, on which a through hole 62 is connected to the supporting rod hole 27 in the switch cover body 12 via a supporting rod 65. Another end has an axial hole 61.

The swing device 60 is connected to an actuating part 50, which has a shaft 52 at one end for insertion into the axial hole 61. Another end of the actuating part 50 is installed with an end part 51, which extends outwards to form a top push piece 511. The bottom side of the top push piece 511 presses the top side of the stopper 42 of the switch cover body 40.

Additionally, an elastic element 66 is installed between the swing device 60 and the actuating part 50 to provide a recovery force for the swing device 60 and the actuating part 50.

A round convex part 71 is installed at proper positions of the elastic contact piece 70. The front end thereof has a contact hole 72, which is connected to an upper contact 73. A fixing base 81 and a joint piece (rivet) 81 are used to join alloy piece 80 with one leg of the alloy piece 80 so that alloy piece 80 is located over the first and the second terminals 45 and 46.

The alloy piece 80 has an approximate U shape and is joined with the first terminal 45 by the fixing base 81 and the joint piece (rivet) 81. The top of the alloy piece 80 pushes the end part 51 of the actuating part 50.

Furthermore, the top end of the second contact terminal 46 has a lower contact terminal 461, which is connected to another pin of the neon lamp 14 by the elastic conductive element (spring) 15, so as to form a complete electric loop.

The actions of the switch in the present invention include OFF, ON, and Trip, when the current is overloaded. The detailed operation will be described in the following.

Figure 2:
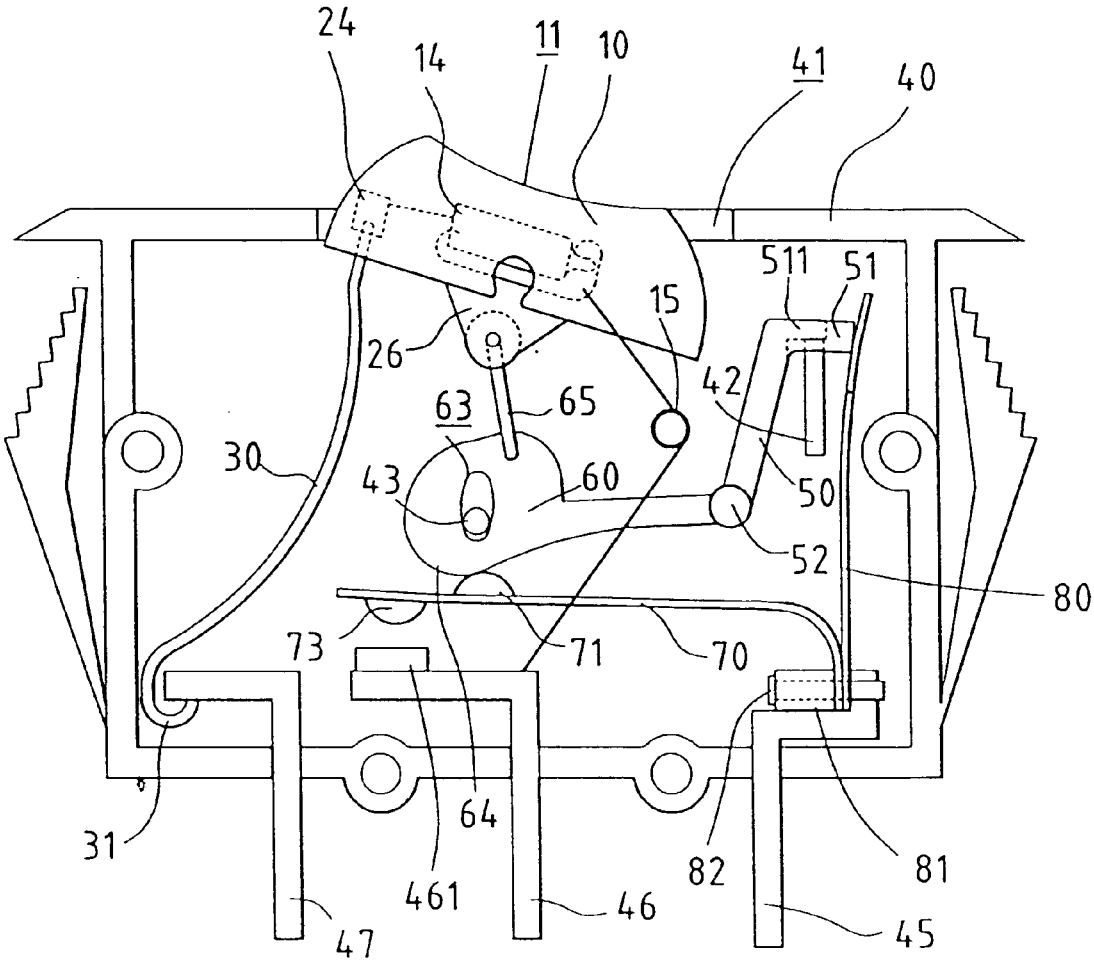
FIG. 2 is a sectional view illustrating the OFF state of the switch structure according to the present invention.

With reference to FIG. 2, the sectional view illustrates the OFF state of the switch according to the present invention when the OFF state is performed by the user. When the user presses the switch body 10 at the right side, the contact reed 30 will extend coordinated with the action so that the switch body 10 clockwise rotates around the fulcrum 21, and the supporting rod hole 27 moves along a round arc (right in this embodiment) clockwise around the fulcrum 21 to cause the upper end of the supporting rod 65 to move in the same direction. The supporting rod 65 drives the through hole 62 of the swing device 60 so that one end of the swing device 60 is pulled upwards to make the convex part 64 not to press the round convex part 71 of the elastic contact piece 70. The elastic contact piece 70 ejects upwards because the pressing force applied by the swing device 60 is released. The upper contact 73 and the lower contact 461 separate apart to make the first contact terminal 45 and the second contact terminal 46 disconnected so as to cut off the power source. At the same time, the neon lamp 14 distinguishes because the second contact terminal 46 has no input power.

Figure 3:
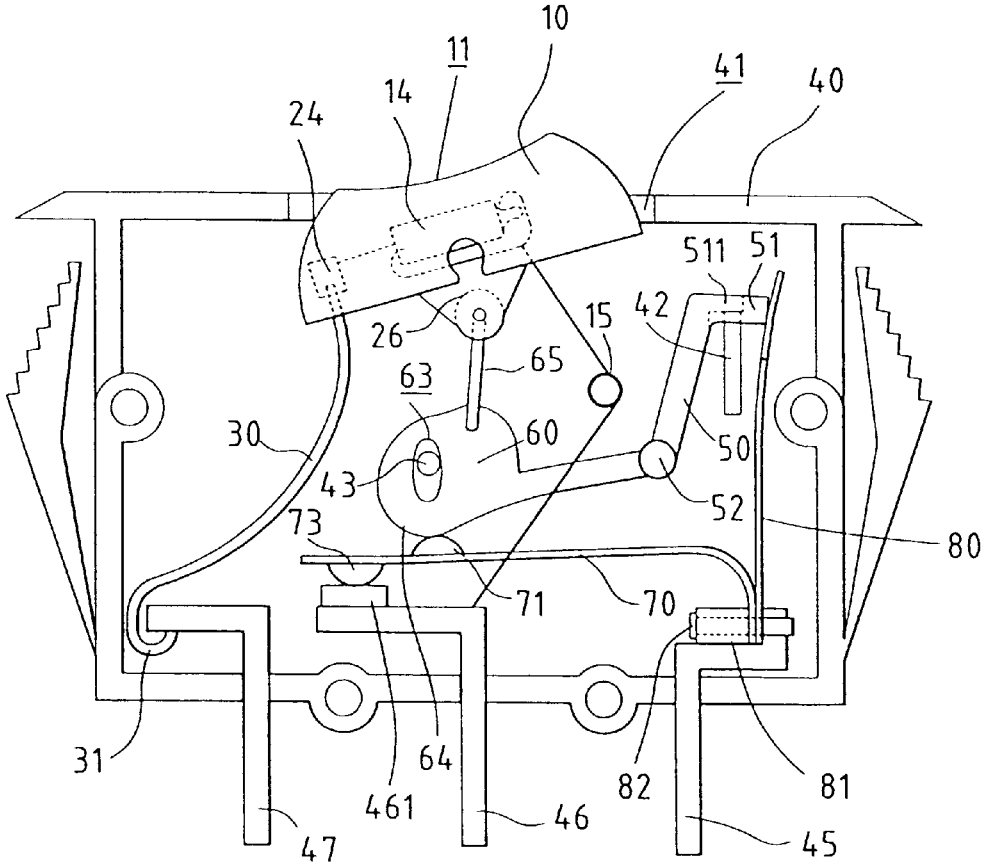
FIG. 3 is a sectional view illustrating the ON state of the switch structure according to the present invention.

With reference to FIG. 3, the sectional view illustrates the ON state of the switch according to the present invention.

When the user presses the switch body 10, the contact reed 30 will deform with the action so that the switch body 10 counterclockwise rotates around the fulcrum 21, and the supporting rod hole 27 moves along a round arc (left in this embodiment) counterclockwise around the fulcrum 21 to cause the upper end of the supporting rod 65 to move in the same direction(upper right). The supporting rod 65 drives the through hole 62 of the swing device 60 so that one end of the swing device 60 is pressed down to make the convex part 64 to press the round convex part 71 of the elastic contact piece 70. The upper contact 73 of the elastic contact piece 70 contacts with the lower contact 461 of the second contact terminal 46. The external current then flows through the first contact terminal 45, the alloy piece 80, the elastic contact piece 70, the upper contact 73, and the lower contact terminal 461 into the second contact terminal 46 to form a complete electric loop as an ON state.

The current is conducted to one pin of the neon lamp 14 via the elastic conductive element (spring) 15 after the above electric loop constructed. Another pin of the neon lamp 14 is connected to the third contact terminal 47 through the chip resistor 24 and the contact reed 30 to form an electric loop and the neon lamp 14 lights up to indicate the switch is ON.

Figure 3A:
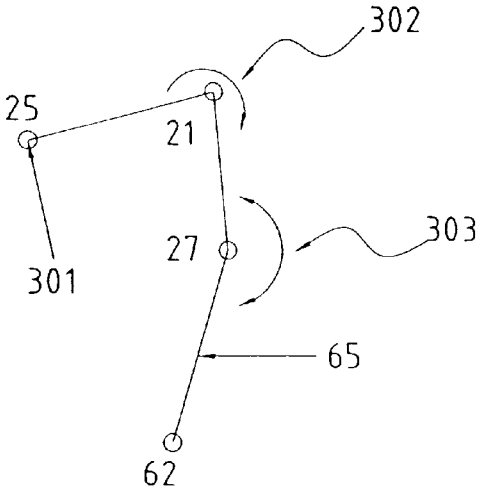
FIG. 3*a* shows a schematic diagram illustrating localized mechanics in FIG. 3.

With reference to FIG. 3*a,* when the switch in ON state, the contact reed 30 is pressed to deform and to store the upwards resilient force 301. Since the through hole 25 is a force applying point, the fulcrum 21 is an axial center, and the distance from the through hole 25 to the fulcrum 21 is an arm of force, the torque 302 is then generated and the angle 303 which has the supporting rod hole 27 as a top point and two sides composed of the sides from the supporting rod hole 27 to the fulcrum 21 and the through hole 62, respectively, is slighter greater than 180 degrees. The switch cover body 10 in ON state can be positioned by the upward ejecting force of the elastic contact piece 70.

Figure 4:
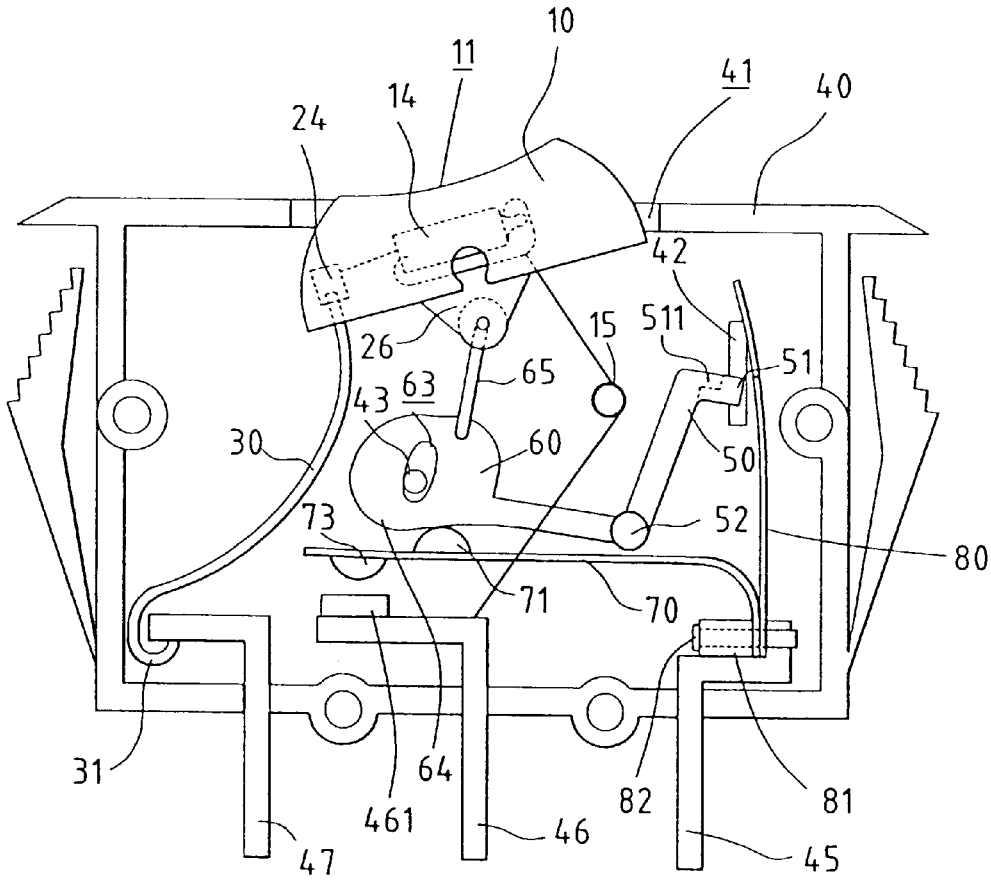
FIG. 4 is a sectional view illustrating the operation of the switch structure according to the present invention when the current is overloaded.

The swing action of the swing device 60 is implemented by using the elliptic slot 63 to confine the fixing pillar 43 to move upwards or downwards, as shown in FIGS. 2, 3, and 4.

It should be noted that the above OFF and ON states are normal states for the current to cut off or to conduct, so the bottom side of the top push piece 511 in the actuating part 50 of the swing device 60 is pushed by the top side of the stopper 42 without any action.

As shown in FIG. 4, the sectional view of the switch according to the present invention illustrates the schematic diagram of ejecting operation when the current is overloaded. When the current generated is overloaded, the alloy piece 80 will bend towards the actuating part 50 of the swing device 60 due to thermal deformation induced by the current. Then, the end part 51 of the actuating part 50 is pushed to cause the actuating part 50 to rotate around the shaft 52 towards the swing device 60 and the elastic element 66 to contact so that the bottom side of the top push piece 511 extended from the end part 51 escapes from the top side of the stopper 42. The actuating part 50 and the swing device 60 lose support and fall down. Therefore, the left end of the actuating part 50 connected with the swing device 60 moves downwards and the elliptic slot 63 moves upwards so that the convex part 64 can not press the round convex part 71 by upward sliding and the elastic contact piece 70 can smoothly move upwards to push due to the resilient force stored by bending. The upper contact 73 and the lower contact 461, thus, separate apart to cut off the power source.

Figure 4A:
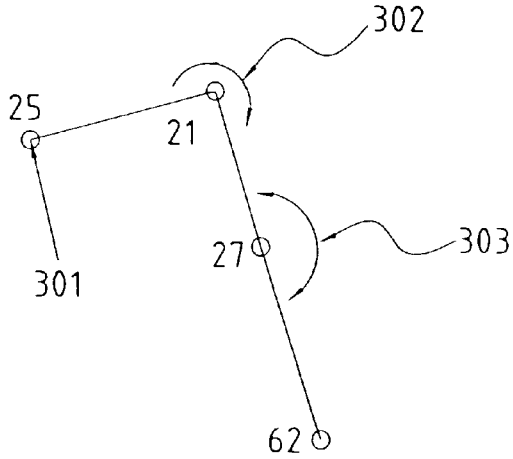
FIG. 4*a* shows a schematic diagram illustrating localized mechanics in FIG. 4.

As shown in FIG. 4*a,* the angle 303 is about 180 degrees so that the torque 302 can easily overcome the reactive force and the elastic force 301 then moves upwards. If the switch cover body 10 is not applied by any external force, the contact reed 30 will release to eject the switch cover body 10. Then, the switch cover body 10 clockwise rotates around the fulcrum 21 towards the OFF position ( as shown in FIG. 2) and the swing device 60 moves upwards and restores back to a normal position as the supporting rod 65 inclines(as shown in FIG. 2). The alloy piece 80 cools down to the original state. The actuating part 50 installed in the swing device 60 places again the bottom side of the top push piece 511 in the end part 51 of the actuating part 50 over top side of the stopper 42 in the switch body 40 by the resilient force of the elastic element 66 so as to prepare for the next switch operation (as shown in FIG. 2).

Accordingly, the switch of the present invention uses the alloy piece 80 and the swing device 60 to rapidly respond to the status of the current so as to eject the elastic contact piece 70 to cut off the power source. The switch can automatically recover to the open state under overloaded current. The response of the present invention is rapid and the structure is simple without any error operation.

Although only the preferred embodiments of this invention were shown and described in the above description, it is requested that any modification or combination that comes within the spirit of this invention be protected.

What is claimed is:

1. A switch structure, comprising a switch body, a switch cover body, a contact reed, a swing device, an alloy piece, an elastic contact piece, wherein said switch body is installed with a fixing pillar and a stopper, and said switch cover body joints with said contact reed, said swing device, and is installed with said alloy piece and said elastic contact piece, which are constructed and assembled in said switch body, wherein:

said swing device has an elliptic hole at one end to connect to said fixing pillar in said switch body so as to swing, and a supporting rod used to insert into a through hole in said swing device to connect to said switch cover body, and anther end of said swing device is installed with an actuating part, which can rotate and is installed with an end part at another end;

said alloy piece is fixed within said switch body, and a top side of said alloy piece pushes the end part of said actuating part installed in the swing device wherein said alloy piece is overheated and bends towards said actuating part when a current is overloaded, to push said actuating part to escape from the stopper in said switch body and then to fall down so that said swing device swings towards an original OFF position to release the elastic contact piece from a pressed status under said swing device to eject upwards, and meanwhile, two contact terminals which construct an electric loop are separated to cut off a power source.

2. The switch structure as claimed in claim 1, wherein an elastic element is installed between said swing device and said actuating part.

3. The switch structure as claimed in claim 1, wherein said end part of the actuating part installed in said swing device extends outwards to form a top push piece, which pushes a top side of the stopper in said switch body.

4. A switch structure, comprising:

a switch body, which has an opening at a top side, is installed with a stopper and a fixing pillar, and comprises a plurality of slots at a bottom side to connect to a first and a second contact terminals, wherein said second contact terminal has a lower contact;

a switch cover body, combining a switch base, which comprises a supporting rod hole at a bottom side;

a swing device, comprising an elliptic slot at one end to combines with said fixing pillar in said switch body, a through hole in said swing device used to connect to said supporting rod hole of the switch cover body by a supporting rod, an axial hole located at another end of said swing device, said swing device further comprising an actuating part, another end of the actuating part having an end part comprising a top push piece, which has a bottom side buckled to a top side of the stopper in the switch body;

an alloy piece, fixed within said switch body and comprising a top side pushing said end part of the actuating part installed in the swing device;

an elastic contact piece, having a upper contact which corresponds to the lower contact of said second contact terminal so that said elastic contact piece is located over said first and said second contact terminals.

5. The switch structure as claimed in claim 4, further comprising a contact reed, which is installed between said switch body and said switch cover body and used to eject said switch cover body.

6. The switch structure as claimed in claim 4, wherein said switch body comprises a third terminal.

7. The switch structure as claimed in claim 4, wherein said switch base of the switch cover body comprises a resistor base at one side, with a chip resistor contacting with said contact reed is inserted into.

8. The switch structure as claimed in claim 4, wherein said switch cover body comprises a neon lamp.

9. The switch structure as claimed in claim 4, wherein one pin of said neon lamp connects to said chip resistor which is connected to said third contact terminal through the contact reed, and another pin of said neon lamp connects to said second contact terminal through an elastic conductive element.

10. The switch structure as claimed in claim 1, wherein said alloy piece connects to said first contact terminal.

11. The switch structure as claimed in claim 4, wherein said alloy piece connects to said first contact terminal.

12. The switch structure as claimed in claim 4, wherein said elastic contact piece connects to said alloy piece.

13. The switch structure as claimed in claim 4, wherein an elastic element is installed between said swing device and said actuating part.

* * * * *